US008434630B2

(12) United States Patent
Clark et al.

(10) Patent No.: US 8,434,630 B2
(45) **Date of Patent: *May 7, 2013**

(54) MERCHANDISING SYSTEM AND METHOD OF ASSEMBLY

(75) Inventors: Jeremy A. Clark, Minneapolis, MN (US); Michael A. Whittier, Minneapolis, MN (US); David H. Cheney, Shoreview, MN (US); James S. LaRue, Fergus Falls, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/488,084

(22) Filed: Jun. 4, 2012

(65) Prior Publication Data

US 2012/0233843 A1 Sep. 20, 2012

Related U.S. Application Data

(60) Continuation of application No. 13/088,854, filed on Apr. 18, 2011, now Pat. No. 8,191,720, which is a division of application No. 12/098,335, filed on Apr. 4, 2008, now Pat. No. 7,946,435.

(51) Int. Cl.
*A47B 47/00* (2006.01)

(52) U.S. Cl.
USPC ..... 211/189; 211/26; 211/204

(58) Field of Classification Search ..... 211/103, 211/175, 186, 187, 188, 189, 190, 191, 204, 211/206, 207; 108/106, 107, 108, 147.11, 108/147.16; 312/265.4
See application file for complete search history.

(56) References Cited

U.S. PATENT DOCUMENTS

| | | | | |
|---|---|---|---|---|
| 1,411,260 | A * | 4/1922 | Baker et al. | 108/107 |
| 2,798,618 | A | 7/1957 | Singer | |
| 2,893,568 | A | 7/1959 | Scholz | |
| 2,896,789 | A | 7/1959 | Sans et al. | |
| 2,919,034 | A | 12/1959 | Levy | |
| 2,923,417 | A | 2/1960 | Sonksen | |
| 2,987,195 | A | 6/1961 | Smith | |
| 2,991,140 | A | 7/1961 | Anderson et al. | |
| 3,081,718 | A | 3/1963 | Shoffner | |
| 3,092,257 | A | 6/1963 | Rountree | |
| 3,186,363 | A | 6/1965 | Moore | |
| 3,209,709 | A | 10/1965 | Shoffner | |
| 3,229,824 | A | 1/1966 | De'Caccia | |
| 3,272,345 | A | 9/1966 | Wallace | |
| 3,297,374 | A | 1/1967 | Radek | |
| 3,329,282 | A | 7/1967 | Swan et al. | |

(Continued)

*Primary Examiner* — Jonathan Liu
*Assistant Examiner* — Joshua Rodden
(74) *Attorney, Agent, or Firm* — Griffiths & Seaton PLLC

(57) ABSTRACT

A method of assembling a merchandising system includes providing a retail display fixture including first and second ends each supporting the retail display fixture on a floor. The method further includes providing a display fixture accessory releasably secured to the retail display fixture and coupling an accessory sheath to the retail display fixture. The accessory sheath includes two substantially planar panels extending substantially parallel to one another and defining a cavity between the two substantially planar panels, a top panel extending between and coupled to each of the two substantially planar panels, and an open bottom providing access to the cavity. Coupling the accessory sheath to the retail display fixture includes sliding the accessory sheath over the display fixture accessory to substantially enclose the display fixture accessory within the cavity such that the accessory sheath substantially covers an entirety of two opposite sides of the display fixture accessory.

17 Claims, 8 Drawing Sheets

U.S. PATENT DOCUMENTS 3,601,256 A 8/1971 Bowers, Jr. et al.
3,626,870 A 12/1971 Schild
3,640,389 A 2/1972 Snyder
3,667,826 A 6/1972 Wood et al.
3,792,917 A 2/1974 Martinez
3,865,250 A 2/1975 Jay
4,046,083 A 9/1977 Murdoch et al.
4,242,970 A 1/1981 Suttles et al.
4,244,411 A 1/1981 Karlstrom et al.
4,331,245 A 5/1982 Schell
4,344,367 A 8/1982 Merl
4,460,097 A 7/1984 Darnell, II et al.
4,573,590 A * 3/1986 Ellis ..... 211/85.15
4,611,866 A 9/1986 Everett
4,633,788 A 1/1987 Robertson
4,760,928 A * 8/1988 Bustos ..... 211/59.4
4,762,235 A 8/1988 Howard et al.
4,925,038 A 5/1990 Gajewski
4,948,154 A 8/1990 Guggenheim
4,954,384 A 9/1990 Hartwell
4,976,360 A 12/1990 Zucker et al.
5,014,862 A 5/1991 Bustos
D318,194 S 7/1991 Terrell et al.
D327,788 S 7/1992 Allen
5,141,105 A 8/1992 Maye
5,372,262 A 12/1994 Benson et al.
5,474,185 A 12/1995 Franke
5,529,192 A 6/1996 Conen et al.
5,535,898 A 7/1996 Burgess, Sr. et al.
5,544,765 A 8/1996 Farbman
5,555,640 A 9/1996 Ou
5,564,579 A 10/1996 Pynenburg et al.
5,566,844 A 10/1996 Bernardin
5,588,376 A 12/1996 Seidl et al.
5,653,349 A 8/1997 Dana et al.
D394,360 S 5/1998 Geier et al.
5,848,498 A 12/1998 Szabo, Sr. et al.
5,887,878 A 3/1999 Tisbo et al.
5,944,203 A 8/1999 Vlah et al.
5,947,307 A 9/1999 Battaglia et al.
6,029,833 A 2/2000 Yeh
6,105,793 A 8/2000 Riga
6,164,467 A 12/2000 DePottey et al.
D450,486 S 11/2001 Stafford et al.
D450,948 S 11/2001 Stafford et al.
D451,300 S 12/2001 Stafford et al.
6,347,714 B1 2/2002 Fournier et al.
6,364,137 B1 4/2002 Glauth et al.
6,405,880 B1 6/2002 Webb
6,427,857 B1 8/2002 Adams et al.
D474,350 S 5/2003 Sardis
6,644,484 B1 11/2003 Sardis
6,880,708 B2 4/2005 Boron
6,959,824 B1 11/2005 Alperson
D530,940 S 10/2006 Raile
D544,730 S 6/2007 Stukenberg
7,261,214 B2 8/2007 Wagner et al.
D554,919 S 11/2007 Clark et al.
D571,130 S 6/2008 Clark et al.
D571,131 S 6/2008 Clark et al.
D602,713 S 10/2009 Stukenberg
7,644,527 B2 1/2010 Clark et al.
7,946,435 B2 * 5/2011 Clark et al. ..... 211/189
8,191,720 B2 * 6/2012 Clark et al. ..... 211/189
2002/0038941 A1 4/2002 Erickson
2004/0173550 A1 9/2004 Adams
2005/0000924 A1 1/2005 Webb
2005/0230338 A1 10/2005 Farinola et al.
2007/0170139 A1 7/2007 Clark et al.
2008/0078728 A1 4/2008 Hodge
2008/0087621 A1 4/2008 Zang et al.
2010/0326931 A1 12/2010 Clark et al.

* cited by examiner

MERCHANDISING SYSTEM AND METHOD OF ASSEMBLY

CROSS-REFERENCE TO RELATED APPLICATIONS

This application is a continuation of U.S. patent application Ser. No. 13/088,854 filed Apr. 18, 2011, now U.S. Pat. No. 8,191,720, issued Jun. 5, 2012, which is a divisional of U.S. patent application Ser. No. 12/098,335, filed Apr. 4, 2008, now U.S. Pat. No. 7,946,435, issued May 24, 2011, the entire contents of each is hereby incorporated by reference in this application.

BACKGROUND

Various types of displays are used to support and present merchandise and provide merchandise information and other information to consumers in a retail environment. Displays that are eye-catching and that readily provide information about a product help draw the attention of the customer and promote retail sales. Additionally, displays that are able to be efficiently set up, broken down, and adjustable are versatile, more easily shipped and stored, and adaptable for use with different base fixtures or mounts. Such displays provide increased sales, better use of employee time, and reduced costs. While traditional displays accomplish these features to some extent, enhancements in the functionality, or overall merchandising effectiveness, of such displays remain to be realized.

SUMMARY

Some aspects of the invention relate to a method of assembling a merchandising system including providing a retail display fixture including a first end and a second end spaced from the first end. Each of the first end and the second end are configured to support the retail display fixture on a floor. The method further comprises providing a display fixture accessory releasably secured to the retail display fixture and coupling an accessory sheath to the retail display fixture. The accessory sheath comprises two substantially planar panels extending substantially parallel to and spaced from one another to define an internal cavity between the two substantially planar panels, a top panel extending between and coupled to each of the two substantially planar panels, and an open bottom providing access to the internal cavity. Coupling the accessory sheath to the retail display fixture includes sliding the accessory sheath over the display fixture accessory to substantially enclose the display fixture accessory within the internal cavity between the two substantially planar panels of the accessory sheath such that the accessory sheath substantially covers an entirety of two opposite sides of the display fixture accessory. The two substantially planar panels of the accessory sheath are configured to support a plurality of products hung from the accessory sheath.

This summary is not intended to be limiting in nature. Various other aspects and embodiments are contemplated and should be understood with reference to the text and drawings that follow.

Figure 1:
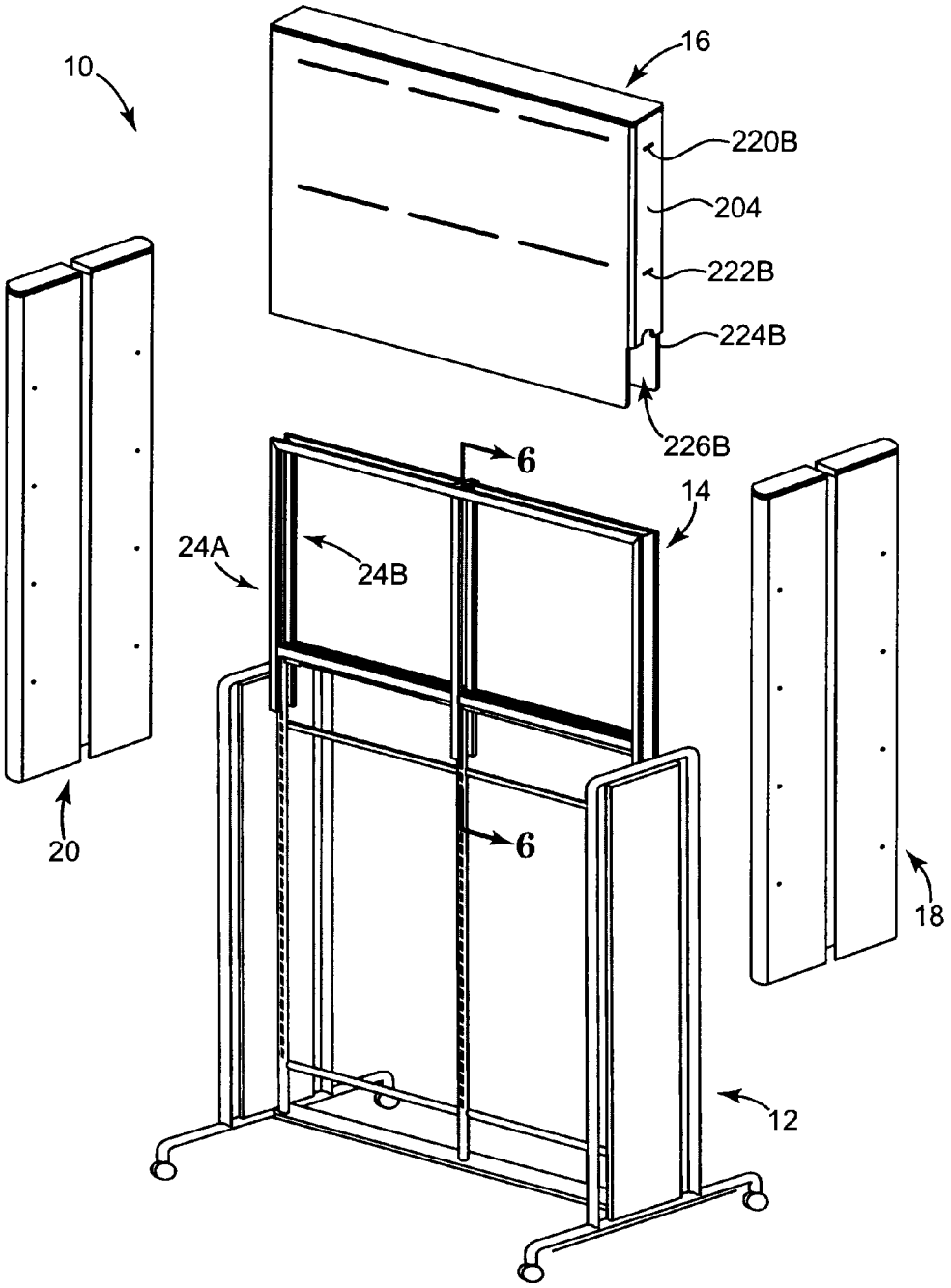
FIG. 1 is an isometric view of a retail system in a partially assembled state, according to some embodiments.

Some embodiments have been shown by way of example in the drawings and are described in detail below. As alluded to above, the intention, however, is not to limit the invention by providing such examples.

DETAILED DESCRIPTION

FIG. 1 shows a display system 10, also described as a racking system or retail system, according to some embodiments. The display system 10 includes a convertible fixture 12 adapted to be rolled on a floor, an extender assembly 14 releasably secured to the convertible fixture 12 and sheaths, or covers, used with the convertible fixture 12 and/or extender assembly 14, where the sheaths include an extender sheath 16, a first end sheath 18, and a second end sheath 20, for example. In general terms, the convertible fixture 12 is used to support, store, and display products for sale in a retail environment; the extender assembly 14 is a retailing accessory to the convertible fixture 12, the extender assembly 14 including a first merchandise extender 24A and a second merchandise extender 24B; and the sheaths 16, 18, 20 are used with the convertible fixture 12 and/or the extender assembly 14 to add and/or modify attachment points, as well as to enhance the overall visual effect presented by the system 10. For example, the sheaths 16, 18, 20 optionally provide a cleaner, more filled-in look as well as providing more surfaces that are colored or decorated as desired.

As shown in FIG. 1, the extender assembly 14 includes first and second merchandise extenders 24A, 24B. The merchandise extenders 24A, 24B are generally formed of metal, such as aluminum or steel, or appropriate plastics. However, a variety of other materials are optionally used. In general terms, the convertible fixture 12, the merchandise extenders 24A, 24B, and the sheaths 16, 18, 20 are each optionally configured to support one or more merchandise support pieces, such as racking components, shelves, hangers, hooks, and others, and/or one or more display pieces, such as billboards, posters, pictures, or pegboards (which, in turn, are optionally used to support merchandising support pieces). The display system 10 is optionally used in a retail environment to support merchandise clothing or other products as desired.

In the description, further reference is made to the accompanying drawings, which form a part hereof, and in which is shown by way of illustration specific embodiments in which the invention may be practiced. In this regard, directional terminology, such as "top," "bottom," "front," "back," "left," "right," etc., is used with reference to the orientation of the Figure(s) being described. Because components of the various embodiments can be positioned in a number of different orientations, the directional terminology is used for the purposes of illustration and is in no way limiting. Additionally, various components and features of embodiments are optionally referred to using alternate names. For example, the convertible fixture 12 is optionally referred to as a main rack, a base rack, a base fixture, or a display fixture; the extender assembly 14 is optionally referred to as an extension assembly, a display extender assembly, or a secondary rack; the extender sheath 16 is optionally referred to as an accessory sheath or assembly cover; and the end sheaths 18, 20 are optionally referred to as clamshell covers, end covers, or end wraps.

Figure 2:
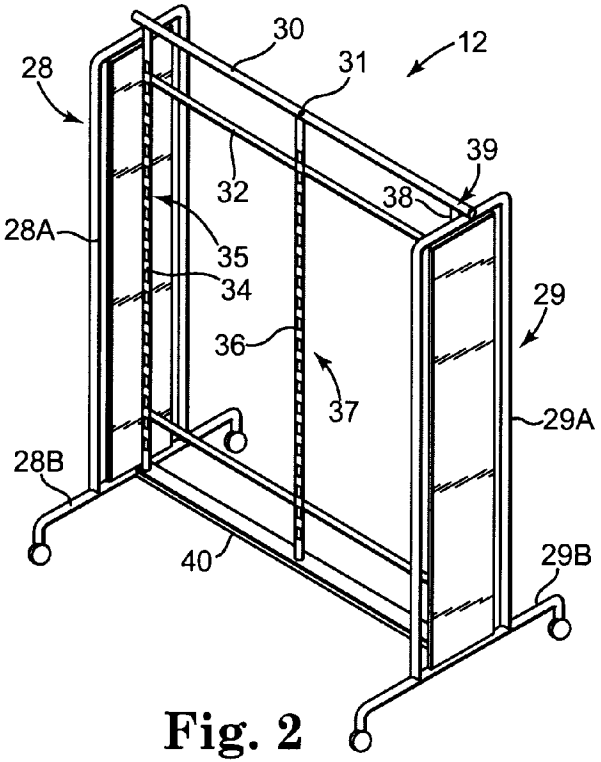
FIG. 2 is an isometric view of a convertible fixture of the system of FIG. 1, according to some embodiments.

FIG. 2 is a perspective view of the convertible fixture 12. The convertible fixture 12 includes a first end piece 28, a second end piece 29, an upper horizontal member 30, an intermediate horizontal member 32, a first outer member 34, a central member 36, a second outer member 38 (partially obscured in FIG. 2), and a lower horizontal member 40. The first and second end pieces 28, 29, also described as end assemblies, are opposingly positioned, on opposite ends, and are adapted to support the convertible fixture 12 on a substantially horizontal surface (not shown). The upper horizontal member 30, intermediate horizontal member 32, and lower horizontal member 40, are optionally referred to as cross-pieces or cross-members, while the first outer member 34, central member 36, and second outer member 38 are optionally referred to as uprights. Each of the upper horizontal member 30, the first outer member 34, the central member 36, and the second outer member 38 is optionally substantially tubular in shape, for example having a substantially round transverse cross-section. However, other cross-sections, for example, rectangular, are also contemplated. The intermediate horizontal member 32 is substantially rectangular in transverse cross-section, and is otherwise described as an elongate band, or strip of material. However, other shapes for the intermediate horizontal member 32 are contemplated, such as a substantially circular shape, for example.

The first end piece 28 has an upper body 28A that includes a tubular framework forming an inverted U-shape. The first end piece 28 also includes a lower wheel assembly 28B secured to the upper body 28A. The second end piece 29 includes an upper body 29A and a lower wheel assembly 29B secured to the upper body 29A, each of which is optionally substantially similar to corresponding components of the first end piece 28.

The upper and intermediate horizontal members 30, 32 span the first outer member 34 and the second outer member 38 to the first and second end pieces 28, 29. The upper horizontal member 30, also described as a first horizontal member, optionally includes a locator pin hole 31 centrally located on the upper horizontal member 30. The first outer member 34 defines a plurality of slots 35 that are optionally substantially rectangular in shape. Each of the plurality of slots 35 is adapted to receive projections, such as L-shaped bracket inserts, or other fastening means (not shown) for releasably securing hangers, hooks, shelves, or other display means to the convertible fixture 12, as desired. The central member 36 and the second outer member 38 each include a plurality of slots 37, 39, respectively (slots 39 are partially obscured in FIG. 2). The pluralities of slots 37, 39 are each optionally substantially similar to the plurality of slots 35 of the first outer member 34. Although not shown, the members 34, 36, 38 also each optionally have a plurality of slots on opposite sides of the members 34, 36, 38.

In some implementations, the merchandise extenders 24A, 24B (FIG. 1) are attached to the convertible fixture 12 to facilitate use of various display pieces, such as product billboards or other merchandising signage, and/or to increase a merchandise carrying and displaying capacity of the convertible fixture 12, for example by providing additional space for shelves, hangers, pegboard material, and others. In some embodiments, the merchandise extenders 24A, 24B are used to increase an overall height of the convertible fixture 12 that would otherwise be available for displaying products or supporting signage, for example. In particular, the first and second merchandise extenders 24A, 24B are optionally assembled to the convertible fixture 12 such that they extend vertically above the convertible fixture 12.

Figure 3:
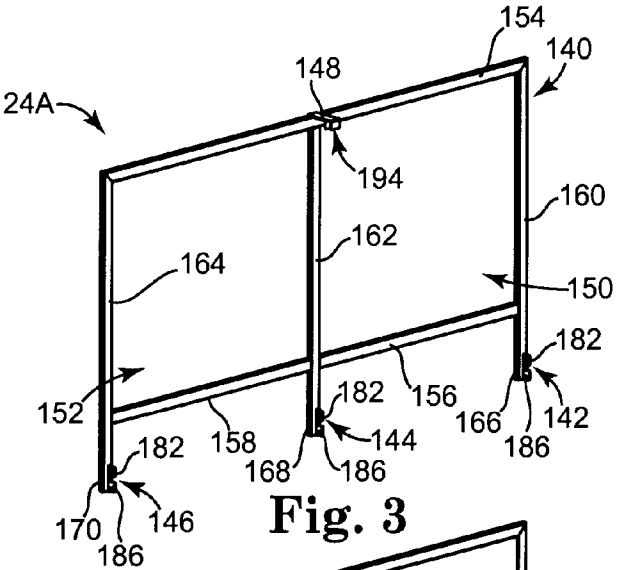
FIG. 3 is an isometric view of a first merchandise extender of the system of FIG. 1, according to some embodiments.
Figure 4:
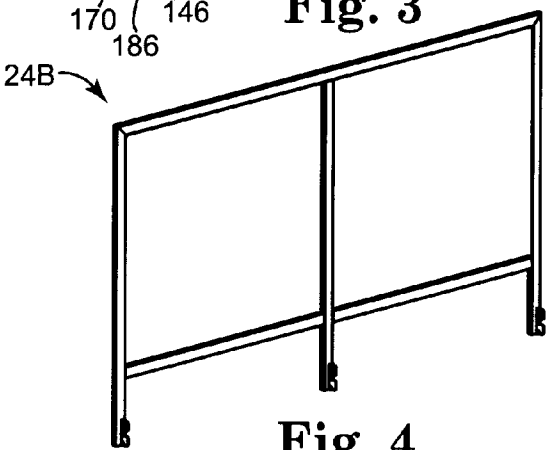
FIG. 4 is an isometric view of a second merchandise extender of the system of FIG. 1, according to some embodiments.

FIG. 3 shows the first merchandise extender 24A from a perspective view and FIG. 4 shows the second merchandise extender 24B from a perspective view. The first and second merchandise extenders 24A, 24B are optionally substantially similar. As such, the second merchandiser extender 24B is described cumulatively with reference to the first merchandise extender 24A.

As shown in FIG. 3, the first merchandise extender 24A includes a frame 140, a first side vertical bracket 142, a central vertical bracket 144, a second side vertical bracket 146, and a lateral bracket 148 (note that the second merchandise extender 24B is free of a corresponding lateral bracket according to some embodiments). The frame 140 optionally defines a first window 150 and a second window 152, each of the two windows 150, 152 being substantially square or rectangular as desired. The frame 140 includes a top cross member 154, a first middle cross member 156, a second middle cross member 158, a first side member 160, a central member 162, and a second side member 164. Each of the first side member 160, the central member 162, and the second side member 164 defines distal portions 166, 168, 170, also described as side legs 166, 170 and a central leg 168, respectively.

As shown, the frame 140 is substantially rectangular in shape with the distal portions 166, 168, 170 extending downwardly relative to a remainder of the frame 140, although other shapes are contemplated. Respective components of the frame 140 are assembled via welding, for example. The top cross member 154, the first middle cross member 156, the second middle cross member 158, the first side member 160, the central member 162, and the second side member 164 are all optionally formed as elongate tubular members having substantially square cross-sections, for example.

The first side vertical bracket 142, the central vertical bracket 144, and the second side vertical bracket 146 are optionally substantially similar. In some embodiments, each of the vertical brackets 142, 144, 146 includes an upper, L-shaped protrusion 182 and a lower, L-shaped protrusion 186. Each of the upper and lower protrusions 182, 186 is adapted to be inserted into the pluralities of slots 35, 37, 39

(FIG. 2) of the members 34, 36, 38 of the convertible fixture 12 (FIG. 2). In particular, the upper and lower projections 182, 186 are insertable into respective ones of the plurality of slots 35, 37, 39. In this manner, the first side vertical bracket 142 is optionally releasably, yet securely maintained on the first outer member 34 (FIG. 2) by inserting portions of the projections 182, 186 into respective slots 35, 37, 39 and lowering the projections 182, 186 onto portions of the members 34, 36, 38 surrounding the slots 35, 37, 39, respectively.

The first side vertical bracket 142 is secured to the first outer member 34 of the convertible fixture 12 using the plurality of slots 35 of the first outer member 34. In turn, the central vertical bracket 144 of the first merchandise extender 24A is attached to the central member 36 using the plurality of slots 37. Additionally, the second vertical bracket 146 is secured to the second outer member 38 using the plurality of slots 39. In particular, each of the vertical brackets 142, 144, and 146 is optionally inserted into pairs of the slots 35, 37, 39 and pressed downwardly to "clip" the vertical brackets 142, 144, 146 in place.

In this manner, the first merchandise extender 24A is optionally secured to the convertible fixture 12 as shown in FIG. 1 at a desired height according to which of the pluralities of slots 35, 37, 39 the first merchandise extender 24A is secured. The second merchandise extender 24B (FIG. 4) is optionally secured to the convertible fixture 12 opposite the first merchandise extender 24A in a substantially similar manner using pluralities of slots formed in the convertible fixture 12 opposite the pluralities of slots 35, 37, 39, for example. Suitable merchandise extenders are described in greater detail in U.S. Pat. App. Pub. No. 2007/0170139, "Display Fixture Accessories," published on Jul. 26, 2007, the entire contents of which are incorporated herein by reference.

If desired, a plurality of shelves (not shown) or other merchandise supports are optionally attached to the convertible fixture 12 using the pluralities of slots 35, 37, 39, for example, where the merchandise supports maintain products such as a plurality of jeans or pants, for example. From the above, it should be apparent that a variety of configurations and products are contemplated.

Figure 6:
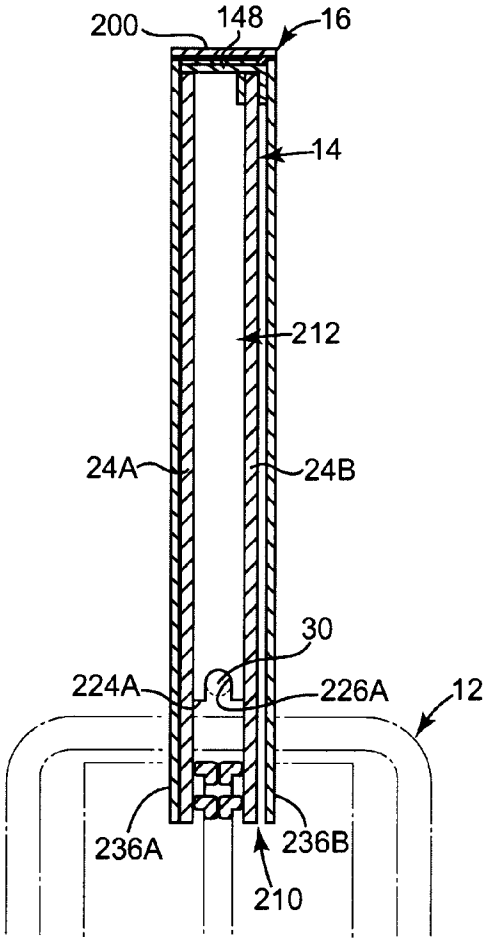
FIG. 6 shows an assembly according to some embodiments, with the extender sheath of FIG. 5 and the merchandise extenders of FIGS. 3 and 4 shown in cross-section and the convertible fixture of FIG. 2 shown in broken lines.
Figure 5:
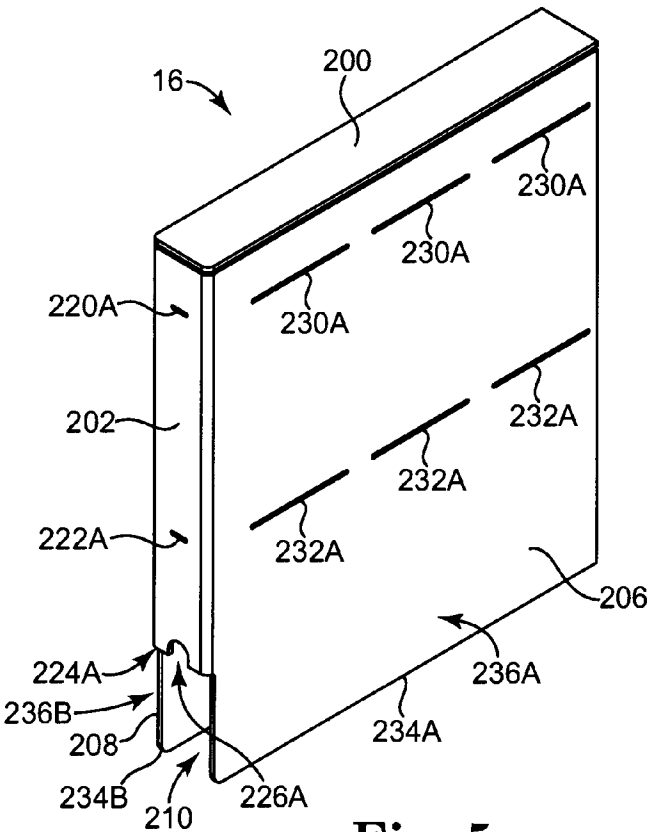
FIG. 5 is an isometric view of an extender sheath of the system of FIG. 1, according to some embodiments.

FIG. 5 shows the extender sheath 16 from a perspective view. The extender sheath 16, also described as a cover, provides means for supporting product support devices, or otherwise provides a plurality of attachment points for product support devices, such as a hanger post 400 (FIGS. 12 and 13) or other slot-mountable fixture accessory. The extender sheath 16 has a closed top 200, a closed first side 202, a closed second side 204 (FIG. 1), a front 206, a back 208 and an open bottom 210 and defines an interior 212 (FIG. 6). The extender sheath 16 defines means for covering the extender assembly 14. In some embodiments, the extender sheath 16 is formed of molded plastic, such as a styrene polymer, or structural foam material, although other materials, for example cardboard, are contemplated.

The first and second sides 202, 204 are optionally substantially similar. In some embodiments, the first side 202 has an upper bracket slot 220A, a lower bracket slot 222A, and a bottom edge 224A including an arcuate cut out 226A adapted to receive the upper horizontal member 30 (FIG. 2). The second side 204 (FIG. 1) has an upper bracket slot 220B, a lower bracket slot 222B, and a bottom edge 224B including an arcuate cut out 226B adapted to receive the upper horizontal member 30. The upper and lower bracket slots 220A, 220B, 222A, 222B (cumulatively referenced as "slots 220, 222") are substantially horizontal, parallel to one another, and formed through the sides 202, 204 respectively. The slots 220, 222 are each optionally adapted or otherwise sized and shaped to receive product support devices, such as the hanger post 400 shown in FIGS. 12 and 13, which is subsequently described in greater detail.

The front 206 and back 208 are optionally substantially similar. As shown in FIG. 5, in some embodiments, the front 206 has a plurality of upper bracket slots 230A, a plurality of lower bracket slots 232A, and a bottom edge 234A that extends below the bottom edges 224A, 224B of the first and second sides 202, 204 such that the front 206 defines a lower skirt portion 236A. The back 208 optionally has a plurality of upper bracket slots (not shown), a plurality of lower bracket slots (not shown), and a bottom edge 234B that extends below the bottom edges 224A, 224B of the first and second sides 202, 204 such that the back 208 defines a lower skirt portion 236B extending below the bottom edges 224A, 224B.

The pluralities of bracket slots 230A, 232A (cumulatively referenced as "slots 230, 232") are each optionally adapted or otherwise sized and shaped to receive product support devices, such as the hanger post 400 shown in FIGS. 12 and 13 and subsequently described in greater detail. Each of the lower skirt portions 236A, 236B are adapted to extend down to cover, or otherwise hide the distal portions (e.g., distal portions 166, 168,170) of the merchandise extenders 24A, 24B. In some embodiments, the lower skirt portions 236A, 236B also help prevent the extender sheath 16 from rocking forward and backward on the extender assembly 14, for example by increasing contact area between the respective components.

FIG. 6 shows an assembly of the fixture 12, extender assembly 14, and extender sheath 16 as would be viewed along line 6-6 of FIG. 1 (FIG. 1 shows the extender sheath 16 disassembled from the fixture 12 and extender assembly 14). In FIG. 6, the extender assembly 14 and extender sheath 16 are shown in cross-section and an outline of the fixture 12 is shown in dotted lines to facilitate understanding. As generally shown, the extender sheath 16 slips over the extender assembly 14, providing means for covering a substantial portion of the extender assembly 14. This assembly is optionally accomplished by sliding the open bottom 210 over the extender assembly 14 until the lower skirt portions 236A, 236B cover the distal portions of the merchandise extenders 24A, 24B (FIGS. 3 and 4). In some embodiments, the extender sheath 16 rests on the extender assembly 14, with the closed top 200 resting on the top cross members of the merchandise extenders 24A, 24B (e.g., top cross member 154 shown in FIG. 3) and the lateral bracket 148. In turn, the bottom edges 224A, 224B (FIG. 1) rest atop the upper horizontal member 30 of the fixture 12 with the arcuate cut outs 226A, 226B (FIG. 1) receiving the upper horizontal member 30.

Figure 7:
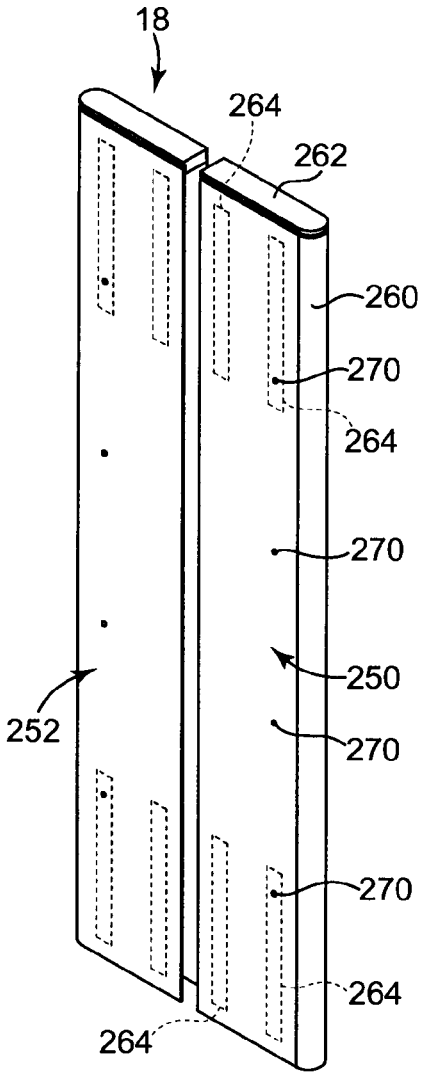
FIG. 7 is an isometric view of an end sheath of the system of FIG. 1, according to some embodiments.

The first and second end sheaths 18, 20 (FIG. 1) are optionally substantially similar and thus are described cumulatively with reference to the first end sheath 18. The first and second end sheaths 18, 20 respectively define means for covering the first and second end pieces 28, 29. FIG. 7 shows the first end sheath 18 from a perspective view, where the first end sheath 18 optionally includes a first clamshell 250 and a second clamshell 252. The first and second clamshells 250, 252, also described as U-shaped housings, are optionally substantially similar and thus are described cumulatively with reference to the first clamshell 250. In particular, the first and second clamshells 250, 252 are substantially mirror images of one another. The first clamshell 250 includes a body 260 and a capper 262, also described as a cap. In some embodiments, the first clamshell 250 also includes fixation means 264, also described as fastener or hanging means, secured to the body 260, such as a hook and loop fastener material (e.g., the hook material portion or the loop material portion) sold under the tradename "VELCRO."

Figure 8:
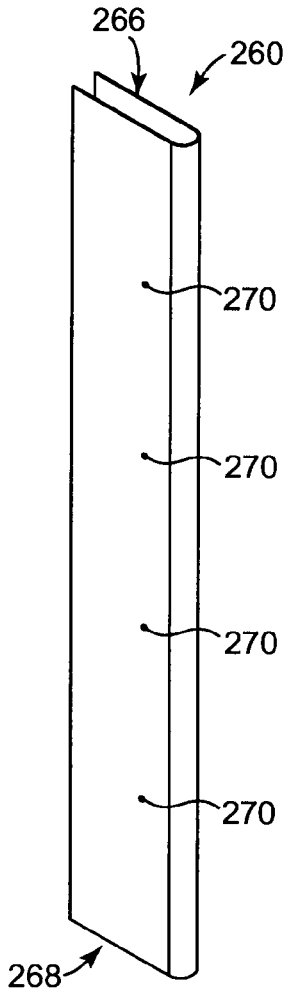
FIG. 8 is an isometric view of a portion of the end sheath of FIG. 7, according to some embodiments.

FIG. 8 shows the body 260 from a perspective view. The body 260 is formed of a thin sheet of material folded over to define a substantially U-shaped transverse cross-section. The body 260 extends over a length from a top 266 to a bottom 268, where the length is generally sized to be complementary to the height of the upper body 28A of the first end piece 28 (FIG. 2), although a variety of sizes are contemplated. In some embodiments the body 260 has a plurality of fastener holes 270 adapted to receive one or more plastic fasteners or rivets, for example, such as those sold by ITW Fastex of Des Plaines, Ill. under the tradename "CANOE CLIPS" or "CHRISTMAS TREE CLIPS."

Figure 9:
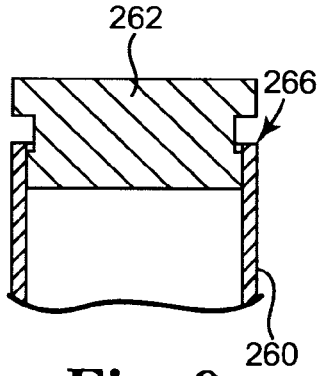
FIG. 9 is an enlarged, cut-off view of a cross-section of the end sheath of FIG. 7, according to some embodiments.

FIG. 9 shows a close-up of a cross-section of the capper 262 as assembled into the top 266 of the body 260. As shown, the capper 262 is substantially I-shaped in transverse cross-section and is complementary in top profile to the transverse cross-section of the body 260. In some embodiments, the capper 262 is retained in the top 266 of the body 260 via a friction fit. In other embodiments, the capper 262 is secured in the top 266 of the body 260, for example, by using an adhesive.

Figure 10:
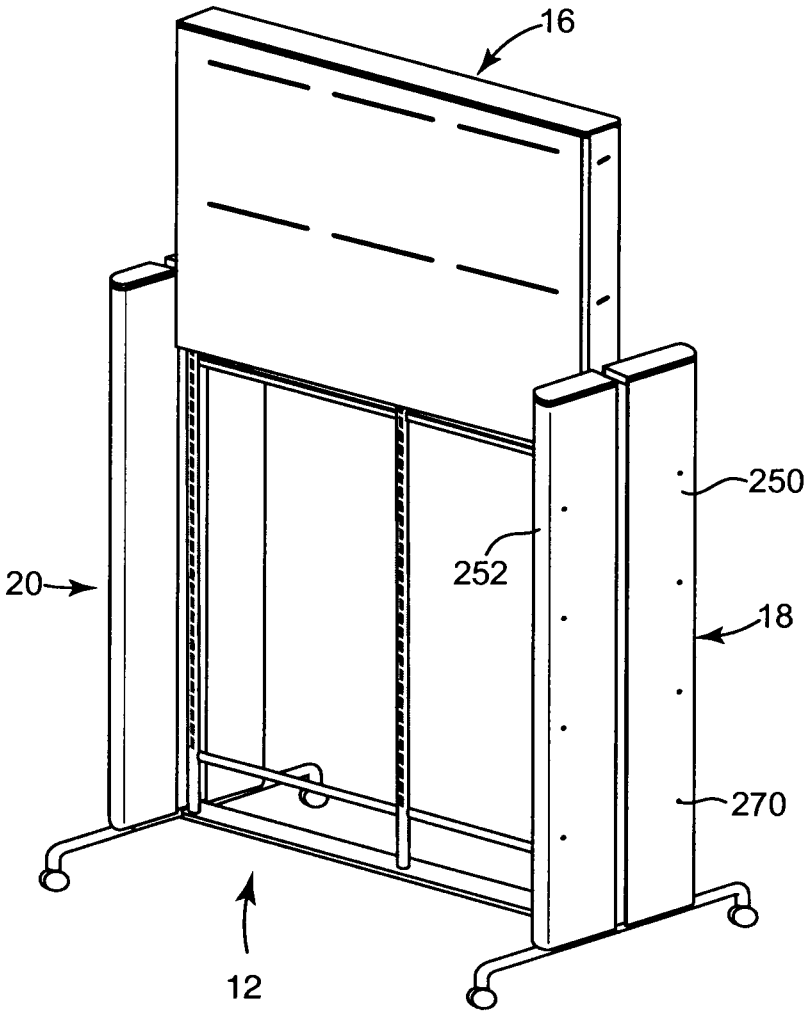
FIG. 10 is an isometric view of the system of FIG. 1 in a more assembled state, according to some embodiments.

FIG. 10 shows the sheaths 16, 18, 20 secured to the extender assembly 14 (FIG. 6) and the fixture 12. As shown in FIG. 10, the first clamshell 250 and the second clamshell 252 of the first end sheath 18 are opposingly positioned about the upper body 28A of the first end piece 28 (FIG. 2) providing means for substantially covering, or enclosing the upper body 28A of the first end piece 28. The second end sheath 20 is optionally secured about the upper body 29A of the second end piece 29 (FIG. 2) in a substantially similar manner such that the sheaths 18, 20 are secured on opposing ends of the fixture 12.

Figure 11:
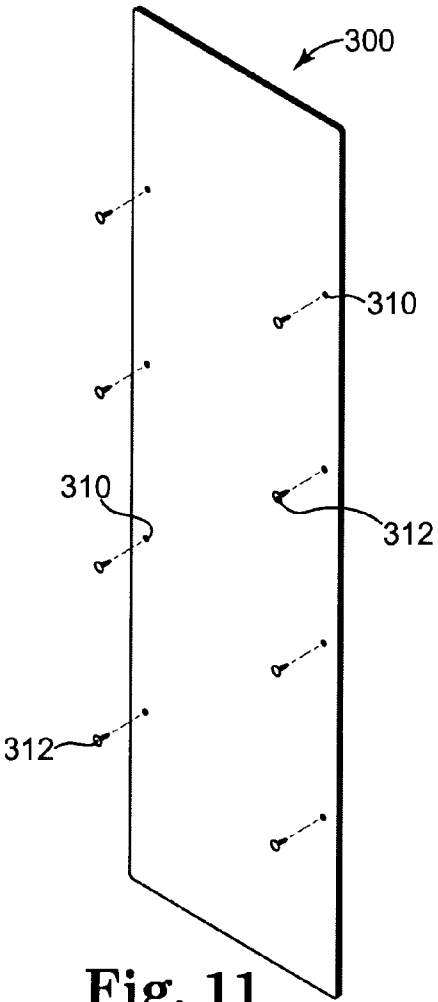
FIG. 11 is an isometric view of a mirror assembly, according to some embodiments.

In some embodiments, a retail device, such as a mirror assembly 300 as shown in FIG. 11 is secured to the first end sheath 18 (FIG. 10). For example, the mirror assembly 300 optionally includes a plurality of fastener holes 310 corresponding to the fastener holes 270 (FIG. 10), where a plurality of fasteners 312 are inserted through the fastener holes 270, 310 to secure the mirror assembly 300 to the first end sheath 18. Alternatively, pegboards, posterboards, billboards, or other sheet-like retail devices are similarly secured to the first end sheath 18 as desired. In other embodiments, the mirror assembly 300 includes complementary fixation means (e.g., hook or loop material) associated with the fixation means 264 for securing the mirror assembly 300 to the first end sheath 18. The second end sheath 20 is similarly used to support retail devices or as otherwise desired.

Figure 12:
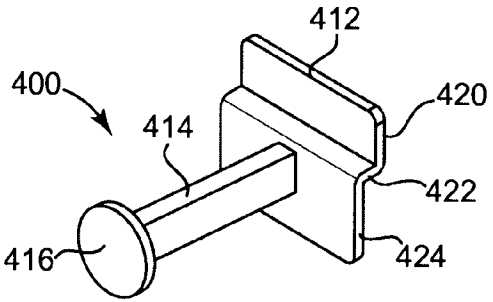
FIG. 12 is an isometric view of a peg hook, according to some embodiments.
Figure 13:
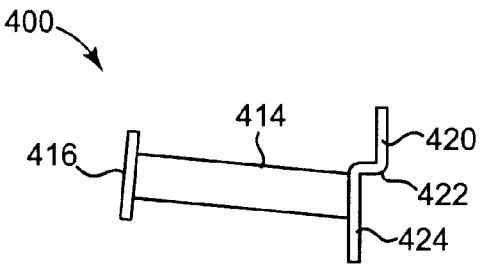
FIG. 13 shows the peg hook of FIG. 12 from a side view, according to some embodiments.

FIGS. 12 and 13 show a hanger post 400, also described as a peg hook or a slot mounted peg, which is one type of slot-mountable fixture accessory used with the extender sheath 16 (FIG. 5). As shown, the hanger post 400 includes a bracket 412, a body 414, and an end stop 416. The bracket 412 includes an upper portion 420, a step portion 422, and a lower portion 424. The bracket 412 is adapted to be secured to the extender sheath 16 using one of the slots 220, 222, 230, 232 (FIG. 5) for example, where the sheath 16 is a means for providing a plurality of attachment points for the bracket 412. The upper portion 420 is substantially upright, the step portion 422 extends substantially orthogonally from the upper portion 420, and the lower portion 424 extends substantially orthogonally from the step portion 422 such that is substantially parallel with, and offset from, the upper portion 420.

In some embodiments, the upper portion 420 is inserted into one of the slots (e.g., one of the plurality of slots 230A) of the extender sheath 16 and the lower portion 424 is pivoted downwardly such that the step portion 422 rests on material defining a bottom edge of a particular slot with the upper portion 420 residing inside the extender sheath 16 and resting against an inner surface of the extender sheath 16 and the lower portion 424 resting against an outer surface (e.g., an outer surface of the front 206) of the extender sheath 16. The body 414 is optionally adapted to support clothing hangers, with the end stop 416 helping to prevent the clothing hangers from sliding off the body 414. Although the bracket 412 is optionally used in association with a peg hook type design adapted to support clothing hangers, bracket designs similar to the bracket 412 are optionally used with shelving (not shown) or other types of fixture accessories to be secured to the extender sheath 16. In view of the foregoing, the extender sheath 16 optionally provides means for augmenting the attachment points and/or to adapt the rack extender assembly 14 (FIG. 1) for use with different types of fixture accessories, such as the hanger post 400.

Figure 14:
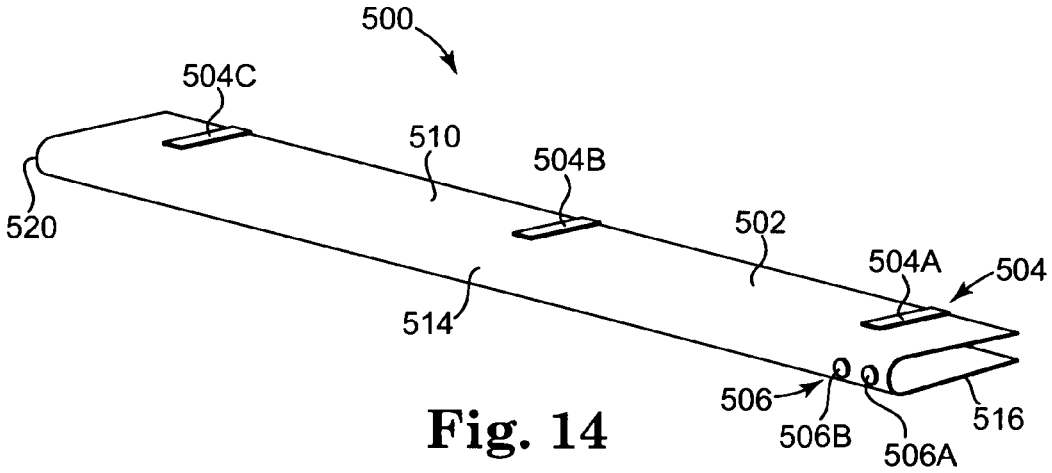
FIG. 14 is an isometric view of another end sheath, according to some embodiments.
Figure 15:
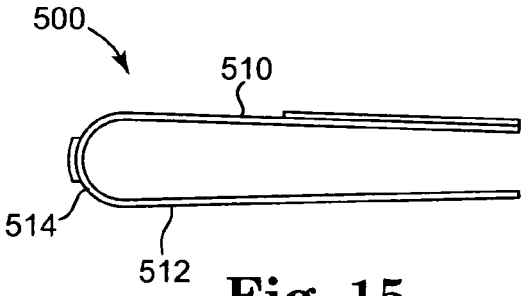
FIG. 15 shows the end sheath of FIG. 14 from a bottom view, according to some embodiments.

FIGS. 14 and 15 show another end sheath 500, also described as an end wrap or clamshell cover, used to cover and/or augment attachment points of the first or second end pieces 28, 29 (FIG. 2), for example. FIG, 14 shows the end sheath 500 from a perspective view and FIG. 15 shows the end sheath 500 from a bottom view. As shown, the end sheath 500 includes a body 502, front fixation means 504, and spine fixation means 506. The body 502 is formed of a thin sheet of material folded over to define a substantially U-shaped transverse cross-section having a front 510, a back 512, and a spine 514. The body 502 extends from a bottom 516 to a top 520 and is generally sized to be complementary to the height of the upper body 28A of the first end piece 28 (FIG. 2), although a variety of sizes are contemplated.

The front fixation means 504 includes a plurality of strips 504A, 504B, 504C of hook and loop material (e.g., a piece of hook material), such as that previously described, dispersed at desired intervals along the front 510 of the body 502. The spine fixation means 506 includes a plurality of dots 506A, 506B of hook and loop material (e.g., a piece of hook material) dispersed on the spine 514 toward the bottom 516 of the body 502. The fixation means 504, 506 are used as desired to secure retail devices, such as posters, billboards, pegboard, or other materials, to the end sheath 500. In some embodiments the body 502 additionally or alternatively has a plurality of fastener holes (not shown) adapted to receive one or more plastic fasteners or rivets, for example, such as those previously described.

In some implementations, the end sheath 500 is slipped over the upper bodies 28A, 29A of one of the first or second end pieces 28, 29 (FIG. 2) and is frictionally retained thereon. For example, the body 502 of the end sheath 500 is optionally somewhat flexible. In use, the front and back 510, 512 are pulled away from one another during positioning and then allowed to engage the end piece (e.g., the upper body 28A of the first end piece 28) with sufficient compressive force to maintain the end sheath 500 in position.

Figure 16:
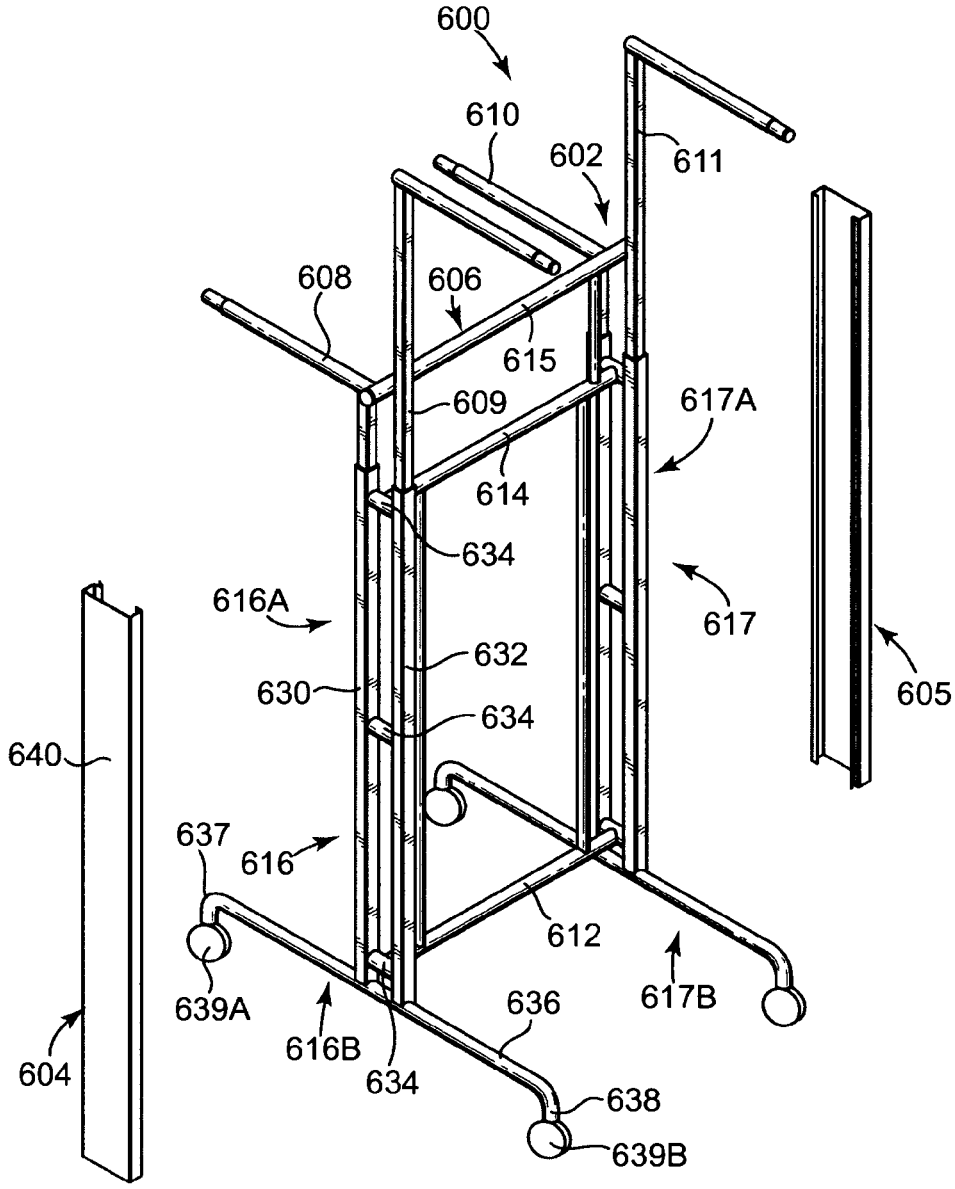
FIG. 16 is an isometric view of another retail system, according to some embodiments.

FIG. 16 illustrates another display system 600 in an unassembled state from a perspective view. The display system 600, also described as a racking system or a merchandising system includes a quad-rack fixture 602, also described as a base rack, a main rack, a base fixture, or a display fixture, a first end sheath 604, also described as a first end cover, and a second end sheath 605, also described as a second end cover.

The quad-rack fixture 602 is generally adapted for displaying merchandise, for example clothing maintained on hangers. The quad-rack fixture 602 includes a frame 606, a first extendable arm 608, a second extendable arm 609, a third extendable arm 610, and a fourth extendable arm 611. The extendable arms 608, 609, 610, 611 are optionally adapted for supporting or otherwise maintaining clothes, hangers, etc. The frame 606 includes a lower cross member 612, an intermediate cross member 614, and a top cross member 615. The quad rack fixture 602 also optionally includes a first end piece 616 and a second end piece 617, the first and second end pieces 616, 617 being adapted to support the quad rack fixture 602 on a surface (not shown).

In some embodiments, the first end piece 616 includes an upper body 616A and a lower wheel assembly 616B secured to the upper body 616A. The upper body 616A optionally includes a first substantially vertical member 630 telescopically receiving the first extendable arm 608 and a second substantially vertical member 632 telescopically receiving the second extendable arm 609. The first and second substantially vertical members 630, 632 are optionally substantially square in transverse cross-section. The first end piece 616 also includes a plurality of cross members 634 extending laterally between the first and second substantially vertical members 630, 632. The lower wheel assembly 616B includes a substantially horizontal base member 636 having a first end 637, a second end 638, and wheels 639A, 639B mounted on each of the first and second ends 637, 638, respectively. The second end piece 617 optionally includes an upper body 617A and lower wheel assembly 617B which are substantially similar to the first end piece 616.

Figure 17:
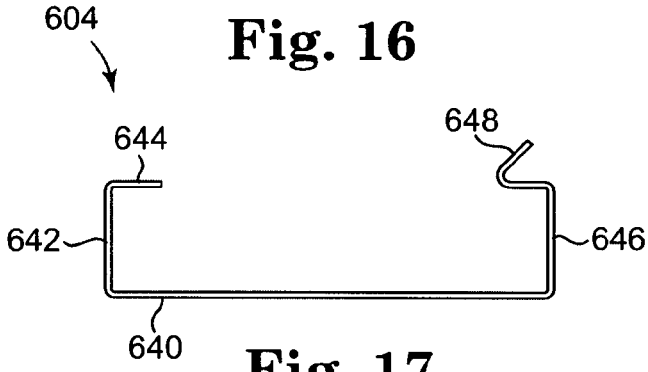
FIG. 17 shows a top view of an end sheath of the system of FIG. 16, according to some embodiments.

The first and second end sheaths 604, 605 are optionally substantially similar and thus are described cumulatively with reference to the first sheath 604. In some embodiments, the first sheath 604 is formed of a molded polymeric material, although other materials are contemplated. As shown, the first sheath 604 has a height that is generally complementary to a height of the first and second substantially vertical members 630, 632. FIG. 17 is a top view of the first end sheath 604. With reference to FIG. 17, the first end sheath 604 includes an outer wall 640, a first sidewall 642, a first lip 644, a second sidewall 646, and a snap fit tab 648.

The first end sheath 604 is optionally sturdy, yet sufficiently flexible to allow the snap fit tab 648 to be flexed away from the first sidewall 642 and first lip 644. In some implementations, the first end sheath 604 is assembled to the first end piece 616 (FIG. 16) by hooking the first lip 644 over the first substantially vertical member 630 and pressing the snap fit tab 648 against the second substantially vertical member 632 until it defects outwardly, allowing the snap fit tab 648 to slip over the second substantially vertical member 632 in a snap fit relationship such that the upper body 616A of the first end piece 616 is releasably retained in the first end sheath 604. Upon assembly, the first substantially vertical member 630 is optionally abutted against the first sidewall 642 while the second substantially vertical member 632 is abutted against the second side wall 646. In order to remove the first end sheath 604, the snap fit tab 648 is moved away in a direction opposite to the first sidewall 642 to release the first end sheath 604 from the upper body 616A. The second end sheath 605 is optionally substantially similarly assembled and disassembled from the second end piece 617.

The first and second end sheaths 604, 605 optionally include fixation means, including any of those previously described, such as fastener holes, bracket slots, or other features for supporting retail devices or other components. In some implementations, the first and second end sheaths 604, 605 are applied to modify an appearance of the quad-rack fixture 602, for example to give a complementary, sheathed visual appearance similar to the sheathed visual appearance of the display system 10.

Various modifications and additions can be made to the embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

In the description, reference is made to the accompanying drawings, which form a part hereof, and in which is shown by way of illustration specific embodiments in which the invention may be practiced. In this regard, directional terminology, such as "top," "bottom," "front," "back," "left," "right," etc., is used with reference to the orientation of the Figure(s) being described. Because components of the various embodiments can be positioned in a number of different orientations, the directional terminology is used for the purposes of illustration and is in no way limiting. The detailed description, therefore, is not to be taken in a limiting sense, and the scope of the present invention is defined by the appended claims.

What is claimed is:

1. A method of assembling a merchandising system, the method comprising:

providing a retail display fixture including a first end and a second end spaced from the first end, wherein each of the first end and the second end are configured to support the retail display fixture on a floor;

providing a display fixture accessory releasably secured to the retail display fixture; and coupling an accessory sheath to the retail display fixture, the accessory sheath comprising:

two substantially planar panels extending substantially parallel to and spaced from one another to define an internal cavity between the two substantially planar panels, a top panel extending between and coupled to each of the two substantially planar panels, and an open bottom providing access to the internal cavity;

wherein:

coupling the accessory sheath to the retail display fixture includes sliding the accessory sheath over the display fixture accessory to substantially enclose the display fixture accessory within the internal cavity between the two substantially planar panels of the accessory sheath such that the accessory sheath substantially covers an entirety of two opposite sides of the display fixture accessory, the two substantially planar panels of the accessory sheath are configured to support a plurality of products hung from the accessory sheath, providing the display fixture accessory includes providing the display fixture accessory to extend above the retail display fixture to increase the overall height of the merchandising system, and the retail display fixture is configured to support products offered for sale below and separately from the display fixture accessory and the accessory sheath.

2. The method of claim 1, wherein:

the display fixture accessory defines a topmost surface, and sliding the accessory sheath over the display fixture accessory includes placing the top panel of the accessory sheath over the topmost surface of the display fixture accessory to hang the accessory sheath to extend downwardly from the topmost surface of the display fixture accessory thereby covering the display fixture accessory.

3. The method of claim 1, wherein at least one of the retail display fixture and the display fixture accessory is formed from metal, and the accessory sheath is formed from one of plastic, structural foam material, and cardboard.

4. A method of assembling a merchandising system, the method comprising:

providing a retail display fixture including a first end and a second end spaced from the first end, wherein each of the first end and the second end are configured to support the retail display fixture on a floor, and the retail display fixture includes a first substantially vertical support structure at the first end and a second substantially vertical support structure at the second end;

providing a display fixture accessory releasably secured to the retail display fixture;

coupling an accessory sheath to the retail display fixture, the accessory sheath comprising:

two substantially planar panels extending substantially parallel to and spaced from one another to define an internal cavity between the two substantially planar panels, a top panel extending between and coupled to each of the two substantially planar panels, and an open bottom providing access to the internal cavity; and coupling a support sheath defining an internal chamber therein over the first substantially vertical support structure such that the first substantially vertical support structure is received and substantially enclosed within the internal chamber of the support sheath;

wherein:

coupling the accessory sheath to the retail display fixture includes sliding the accessory sheath over the display fixture accessory to substantially enclose the display fixture accessory within the internal cavity between the two substantially planar panels of the accessory sheath such that the accessory sheath substantially covers an entirety of two opposite sides of the display fixture accessory, the two substantially planar panels of the accessory sheath are configured to support a plurality of products hung from the accessory sheath, and the two substantially planar panels of the accessory sheath each extend in a different substantially vertical plane substantially perpendicular to each of the first substantially vertical support structure and the second substantially vertical support structure.

5. The method of claim 4, wherein coupling the support sheath over the first substantially vertical support structure comprises providing the support sheath to have an outer face including hanging means for supporting a retail device.

6. A method of assembling a merchandising system, the method comprising:

providing a retail display fixture including a first end and a second end spaced from the first end, wherein each of the first end and the second end are configured to support the retail display fixture on a floor;

providing a display fixture accessory releasably secured to the retail display fixture;

coupling an accessory sheath to the retail display fixture, the accessory sheath comprising:

two substantially planar panels extending substantially parallel to and spaced from one another to define an internal cavity between the two substantially planar panels, a top panel extending between and coupled to each of the two substantially planar panels, and an open bottom providing access to the internal cavity, wherein:

coupling the accessory sheath to the retail display fixture includes sliding the accessory sheath over the display fixture accessory to substantially enclose the display fixture accessory within the internal cavity between the two substantially planar panels of the accessory sheath such that the accessory sheath substantially covers an entirety of two opposite sides of the display fixture accessory, and the two substantially planar panels of the accessory sheath are configured to support a plurality of products hung from the accessory sheath; and supporting a plurality of products with the accessory sheath including:

inserting an upper portion of a hanging bracket into the accessory sheath, resting a step portion of the hanging bracket on a lower edge of the accessory sheath, and resting a lower portion of the hanging bracket on a front face of the accessory sheath, wherein the upper portion is substantially upright, the step portion extends substantially orthogonally from the upper portion, and the lower portion extends substantially orthogonally to the step portion such that the lower portion is substantially parallel with, and offset from, the upper portion of the hanging bracket.

7. A method of assembling a display system comprising:

providing a base fixture adapted to support merchandise in a retail environment, the base fixture including a first outer member and a second outer member positioned opposite the first outer member, and a first cross member extending between the first and second outer members;

releasably securing a display extender to each of the first and second outer members such that the display extender extends above each of the first and second outer members and the first cross member; and securing an extender cover over the display extender, the extender cover being a box-type construction forming an internal cavity and an open bottom providing access to the internal cavity;

wherein:

securing the extender cover over the display extender includes placing the extender cover over the display extender such that the display extender is substantially entirely enclosed within the internal cavity and the extender cover is supported by a top surface of the display extender, and the extender cover includes a front panel and a rear panel opposite the front panel with each substantially covering an opposite side of the display extender and being configured to support one or more merchandise items being offered for retail sale in the retail environment.

8. The method of claim 7, wherein securing the extender cover includes positioning each of the front panel and the rear panel of the extender cover to extend substantially vertically and substantially parallel to the first cross bar.

9. The method of claim 8, wherein the extender cover includes a first side panel and a second side panel opposite the first side panel, and each of the first and second side panels extend substantially perpendicularly to the front and rear panels and are provided with a bottom edge adapted to receive the first cross member of the base fixture in a substantially complementary fit.

10. The method of claim 7, wherein:

the display extender is a first display extender, the method further comprises releasably securing a second display extender to each of the first and second outer members such that the second display extender extends above each of the first and second outer members and the first cross member, and the second display extender is positioned on an opposite side of the first cross bar as compared to the position of the first display extender, and securing the extender cover over the first display extender includes securing the extender cover over both the first display extender and the second display extender such that the first display extender and the second display extender are substantially entirely enclosed within the internal cavity and the extender cover is supported by the top surface of the first display extender and a top surface of the second display extender.

11. The method of claim 7, wherein:

the base fixture includes a first end piece extending substantially perpendicularly to the first cross bar outside the first outer member and a second end piece extending substantially perpendicular to the first cross bar outside the second outer member, the method further comprises fitting a first clamshell end cover over the first end piece and a second clamshell end cover over the second end piece, and each of the clamshell end covers has an outer face including hanging means for supporting a retail device.

12. A method of assembling a display system comprising:

securing a plurality of uprights together into a main rack with a plurality of cross members each extending from one of the plurality of uprights to another one of the plurality of uprights;

releasably securing a secondary rack to at least two of the plurality of uprights of the main rack such that the secondary rack extends substantially vertically upwardly from and above the main rack; and covering the secondary rack with an extender box, the extender box including:

a plurality of walls defining a space substantially enclosed between the plurality of walls, at least two of the plurality of walls including one or more attachment points configured to receive a bracket for supporting merchandise offered for retail sale, and an open bottom providing access to the space, wherein covering the secondary rack with the extender box includes sliding the extender box over the secondary rack to place the secondary rack substantially entirely within the space of the extender box.

13. The method of claim 12, further comprising:

securing a first end piece and a second end piece on opposing sides of the main rack, the first and second end pieces being adapted to support the main rack on a floor and each extending in a direction substantially perpendicular to an extension of each of the at least two of the plurality of walls; and covering the first and second end pieces with sheathing substantially enclosing the first and second end pieces.

14. The method of claim 12, wherein the covering the secondary rack comprises securing the extender box over the secondary rack such that the extender box is supported in a substantially vertical orientation, wherein a top of the extender box is supported by a top of the secondary rack.

15. The method of claim 12, wherein the extender box includes first and second sides opposite one another and each defining a bottom edge defining a cutout portion adapted to sit on and receive one of the plurality of cross members of the main rack in a substantially complementary fit.

16. The method of claim 12, wherein:

each of the at least two of the plurality of uprights of the main rack defines a linear vertical array of slots configured to receive L-shaped brackets, the secondary rack includes an L-shaped bracket on each of two lower ends of the secondary rack, and releasably securing the secondary rack to the at least two of the plurality of uprights includes releasably securing the L-shaped bracket on one of the two lower ends of the secondary rack with one or more of the slots of one of the at least two of the plurality of uprights.

17. The method of claim 12, wherein:

the one or more attachment points are each an elongated slot, and the method further comprises:

hanging a support bracket from the extender box via one of the elongated slots, and placing merchandise on the support bracket.

* * * * *